United States Patent [19]

Jungkind

[11] Patent Number: 4,948,159

[45] Date of Patent: Aug. 14, 1990

[54] SAFETY SKI BINDING

[75] Inventor: Roland Jungkind, Garmisch-Partenkirchen, Fed. Rep. of Germany

[73] Assignee: Marker Deutschland GmbH, Eschenlohe, Fed. Rep. of Germany

[21] Appl. No.: 298,417

[22] Filed: Jan. 18, 1989

[30] Foreign Application Priority Data

Jan. 18, 1988 [DE] Fed. Rep. of Germany ..... 3801213

[51] Int. Cl.[5] ..... A63C 9/082

[52] U.S. Cl. ..... 280/632; 280/628; 280/612

[58] Field of Search ..... 280/612, 611, 628, 627, 280/630, 631, 634

[56] References Cited

U.S. PATENT DOCUMENTS 4,624,474 11/1986 Klubitschko et al. ..... 280/612

4,657,278 4/1987 Klubitschko ..... 280/612

*Primary Examiner*—David M. Mitchell

*Attorney, Agent, or Firm*—D. Peter Hochberg; Mark Kusner; Louis J. Weisz

[57] ABSTRACT

A safety ski binding comprised of first and second jaw units for retaining a ski boot on the ski. The first jaw unit includes a contact switch, which will be actuated in response to predetermined forces which are transmitted from the ski boot to the first unit, the forces being transmitted in at least two planes which are at right angles to each other. The first jaw unit includes an axle mounted to a base plate, a cam surface on the axle, a boot holder mounted on the axle for rotational axial movement thereon, a first spring operable to bias the boot holder into rotation about the axle, a second spring disposed between the axle and the boot holder operable to bias the boot holder to a central position on the axle, a pin which is parallel to the transverse axle and held on the base plate, and a control lever rotatably and axially movable on the pin controlling a release mechanism for holding the ski boot on the ski. The control lever has a first lever end engaging a cam surface on the axle and a second end operative to engage the boot holder wherein the boot holder engages the second lever end that imparts rotational movement to the control lever when the boot holder moves from a first boot holding position toward a second boot release position. The control lever is arranged to move axially with the soleholder as the soleholder moves along the axle wherein the first lever end moves along a cam surface which imparts rotational movement to the control lever.

12 Claims, 3 Drawing Sheets

SAFETY SKI BINDING

FIELD OF INVENTION

The present invention relates to safety ski bindings.

BACKGROUND OF THE INVENTION

The present invention pertains to a safety ski binding of a type shown in EP 0091574B1, which discloses a safety ski binding having a first jaw unit (a so called "sensing unit") which cannot be released. The first jaw unit is provided with two soleholders which engage the sole of a ski boot from above and from lateral respective sides. These soleholders are mounted on a common pin which permits a slight lateral pivotal movement. A bearing member which carries such pin also permits slight pivotal movement about a horizontal transverse axle which is mounted in a housing that is secured to the ski. Contact switches, which are actuated when such pivot movements reach predetermined values, are provided and are comprised of three pressure pickups which are installed within the housing. Such a design permits the detection of forces which occur adjacent to the sensing jaw unit. Whereas such a ski binding had certain advantages over other known safety ski bindings, it has met with limited acceptance probably due to the fact that the sensing jaw is relatively complex and involves a high structural expenditure. In this respect, the disclosed device includes pressure-applying pistons and pressure pickups which inherently include sealing problems.

It an object of the present invention to provide a safety ski binding which is of a type as heretofore described, but which is designed such that it can be manufactured in a simple manner, at a lower cost and with less susceptibility to malfunction.

In accordance with the present invention there is provided a sensing unit for use with a releasable safety ski binding for retaining a ski boot on a ski. The binding includes a base plate attachable to the ski having an axle mounted thereon. The axle is transverse to the axis of the ski and parallel to the surface thereof. A cam surface is associated with the axle and a ski boot holder is mounted on the axle for rotational and axial movement thereon. The boot holder is dimensioned to hold a ski boot laterally and from above and has a boot holding position and a boot release position. First spring means are provided to bias the boot holder into rotation about the axle toward the boot holding position. Second spring means are provided and disposed between the axle and the boot holder to bias the boot holder to a central position on the axle. Pin means, parallel to the axle, are mounted to the base plate. The pin means are secured to a locking mechanism and are received in slot means in the boot holder such that the boot holder is pivotally movable to a small extent from a boot holding position when the locking mechanism is in the first position. Control lever means is rotatably and axially mounted on the pin means for controlling the electronic circuit and release of the release member. The control lever has a first lever end engaging the cam surface on the axle and a second lever end operative to engage the boot holder wherein the boot holder engages the second lever end and imparts rotational movement to the control lever when the boot holder moves from the boot holding position. Means are provided for axially moving the control lever along the pin as the soleholder moves along the axle wherein the first lever end moves along the cam surface which imparts rotational movement through the control lever as the soleholder moves from the central position.

In accordance with a preferred aspect of the present invention, the soleholder may be mounted on the horizontal transverse axle with two bushings disposed between the soleholder and the axle. The bushings are preferably stationary on the axle, and reduce the frictional resistance which opposes movement of the soleholder on the axle. Preferably, a helical compression spring is mounted on the transverse axle between the two bushings, and the soleholder is provided with a cylindrical recess having a length equal to the distance by which the bushings are spaced apart. In this respect, the helical compression spring bears at its ends on both the bushing and the soleholder when the spring is in its normal position. Accordingly, as the soleholder is urged laterally from its normal or central position, the helical compression spring will be compressed between one side of the cylindrical recess and one of the bushings. Preferably, the outer ends of the bushings slightly protrude from the soleholder when the soleholder is in its normal position such that the soleholder can axially be displaced from its central or normal position on the transverse axle to either side to a small extent against the biasing force of the compression spring.

In accordance with another aspect of the present invention, the soleholder includes a control lever having first and second lever ends. The second lever end extends downwardly from the horizontal transverse axle and is operatively connected to a foot plate which is movably mounted on the base plate. The foot plate takes up pressure from the ball portion of the skiing boot. In this respect, movement of the foot plate resulting from pressure changes exerted by the ski boot effects the soleholder.

Preferably, the soleholder is mounted on the base portion such that a slight pivotal movement away from the ski boot against the first biasing force is provided. In this respect, the pin means is comprised of a pin which extends through two slots which are formed in lug portions provided on the soleholder. The outer ends of the slots bear on the pin under the action of a compression spring when the soleholder is in its normal position. In this respect, it is desirable to mount the pin such that it is axially movable relative to the base portion but that the soleholder and the control lever are displaceable on the pin in a longitudinal direction along the axis of the ski.

In accordance with the present invention, the soleholder is provided with a recess which serves to receive the control lever and has vertical side surfaces which constitute one way coupling elements associated with the control lever. The control lever as set forth above has two ends, wherein the second end serves as a stop and has a one way coupling element for engagement with the soleholder.

The present invention has heretofore been described as a sensing unit for use with a releasable safety ski binding. In accordance with another aspect of the present invention, the sensing unit heretofore described may also be utilized as part of an automatically releasable jaw unit. In this respect, the sensing unit described above would further include releasable locking means on the base plate for supporting the soleholder. The locking means may comprise a locking member which is adapted to be released by an electromagnet of an electronic circuit. Such releasable locking means may also be used in conjunction with an automatically releasable jaw unit. In this respect, a pin is mounted in a thrust bar which is supported on the base plate for longitudinal movement and is held in a normal position by the locking member. A toggle joint assembly having pivots extending parallel to the transverse axle are provided between the supported ends of the thrust bar and the base plate. In this respect the locking member engages the hinge of the toggle joint from one side thereof and the toggle joint is biased by a return spring. The locking member is preferably comprised of a rotatable element which is mounted on the base plate on a pivot which is parallel to the transverse axle.

DRAWINGS

The invention may take physical form in certain parts and arrangement of parts, a preferred embodiment of which will be described in detail in the specification and illustrated in the accompanying drawings wherein.

DETAILED DESCRIPTION OF PREFERRED EMBODIMENT

Figure 1:
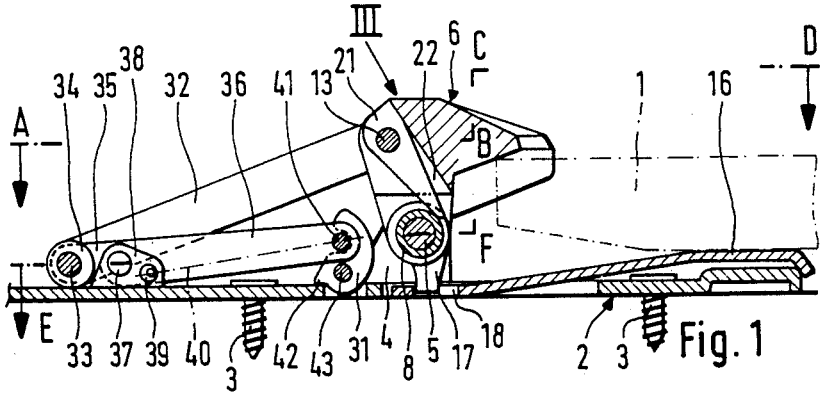
FIG. 1 is an elevational sectional view taken along line G-H of FIG. 2 showing a jaw unit of a safety ski binding illustrating a preferred embodiment of the present invention.

Referring now to the drawings wherein the showing is for the purpose of illustrating a preferred embodiment of the invention and not for the purpose of limiting same, FIG. 1 illustrates a first jaw unit which together with a second jaw unit (not shown) comprises a safety ski binding for retaining a ski boot on a ski. The illustrated jaw unit cooperates with the toe end 1 (shown in phantom in the drawings) of the sole of the ski boot. The second jaw unit (not shown) cooperates with the heel end of the sole. Such jaw unit can arbitrarily be opened and closed in a known manner, and its design in and of itself forms no part of the present invention. In this respect, the first jaw unit is so designed such that the second jaw unit (not shown) need not necessarily be provided with means for an automatic release in response to excessive loads thereon.

The present invention is preferably for use with an electronic circuit (not shown), which in response to a rise above a predetermined limiting value delivers a release signal for an automatically releasably jaw unit. The electronic circuit in and of itself forms no part of the present invention and therefore shall be described only briefly. An electronic circuit generates a signal for initiating a release of the jaw unit when predetermined limiting values have been exceeded. According to the present invention, the electronic circuit preferably comprises a contact switch, which provides a connection between the circuit and the jaw unit. The contact switch is actuated when predetermined forces are exerted and are transmitted from the ski boot to the jaw unit in at least two planes of action which are at right angles to each other.

Figure 2:
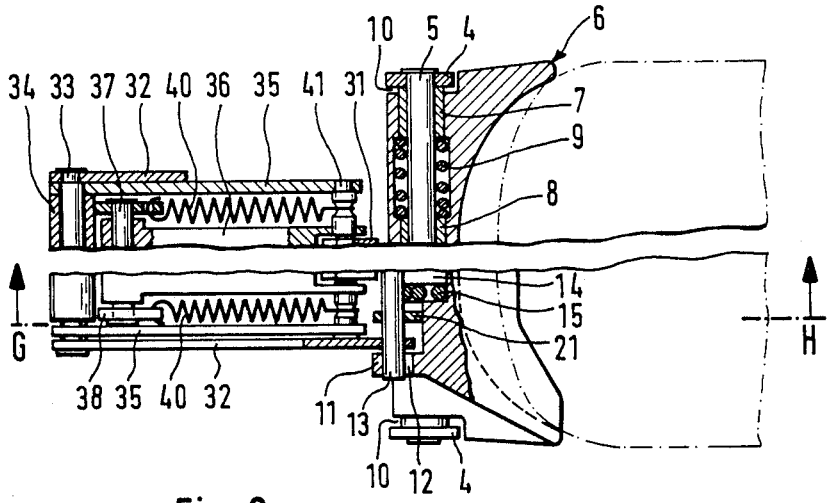
FIG. 2 is a plan sectional view of the bindings shown in FIG. 1 wherein its lower half is a sectional view taken along line A-B-C-D of FIG. 1 and its upper half is a sectional view taken along line E-F-C-D of FIG. 1.

The first jaw unit is comprised of a base plate 2, which is adapted to be mounted to a ski (not shown) by screws 3. A horizontal transverse axle 5 is fixedly mounted in lugs 4 which extend from base plate 2. A soleholder 6 is pivotally mounted on axle 5 and engages the toe end 1 of the sole of the ski boot. Soleholder 6 is dimensioned to engage the toe of the ski boot laterally and from above. Soleholder 6 is mounted on transverse axle 5 with two bushings 7, 8 disposed therebetween. Bushings 7 and 8 are fixedly mounted on axle 5 to prevent axial movement thereon. A helical compression spring 9 is mounted on transverse axle 5 between bushings 7 and 8. Soleholder 6 includes a cylindrical recess (best seen in FIG. 2) having a length which is equal to the distance by which bushings 7, 8 are spaced apart. At its ends, helical compression spring 9 bear on bushings 7, 8 and on the ends of the cylindrical recess of soleholder 6 when the soleholder is in its normal or central position. As best seen in FIG. 2, a gap 10 is provided between each lug 4 and soleholder 6 such that the soleholder is capable of a limited movement along axle 5 relative to base plate 2 against a force of helical compression spring 9.

On the portion of soleholder 6 which is remote from the ski boot, i.e. the left hand side of the jaw unit shown in FIGS. 1 and 2, soleholder 6 is provided with two lugs 11 which are formed with slots 12 therein. Slots 12 are dimensioned to receive a pin 13 therein. Pin 13 is parallel to transverse axle 5 and when the jaw unit is in a normal position for use is supported on base plate 2 by means which shall be described below. When soleholder 7 is in its normal position, the outer ends of slots 12 bear resiliently on pin 13. In this respect, a helical compression spring 15 which bears on pin 13 is provided in an opening 14 formed within soleholder 6. As a result, soleholder 6 is capable of a pivotal movement about the transverse axle 5 against the force of the helical compression spring 15 to an extent determined by the length of slots 12 (See FIG. 2).

In accordance with one aspect of the present invention, the toe end 1 of the sole of the ski boot can be supported by a foot plate 16, which is movably mounted on base plate 2. Foot plate 16 is preferably mounted on base plate 2 in such a manner that a corresponding pressure applied by the ball of the foot will move foot plate 16 in a predetermined direction (to the right in the drawing) to impart the pivotal movement to soleholder 6 against the force of helical compression spring 15. To this end, soleholder 6 includes an arm 17 which extends downwardly beyond transverse axle 5 and engages the edge of an aperture 18 in foot plate 16. The direction in which pressure is applied by the ball of the foot will be changed in a known manner by the cooperation of properly designed portions of foot plate 16 and base plate 2 in the manner of a sliding-wedge mechanism.

A control lever 21 is pivotally mounted on pin 13 and is axially movable therealong. Control lever 21 extends into an indentation or recess 22 in soleholder 6. Indentation 22 is dimensioned to provide three-one way coupling elements wherein the control lever will follow movements performed by the soleholder along axle 5 and about axle 5, as will now be described with reference to FIGS. 3 and 4.

Figure 3:
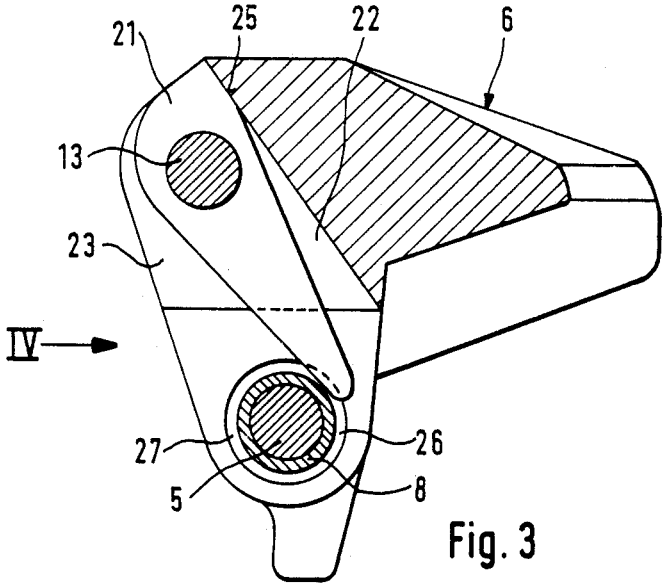
FIG. 3 is an enlarged partially sectioned view showing area III of FIG. 1.
Figure 4:
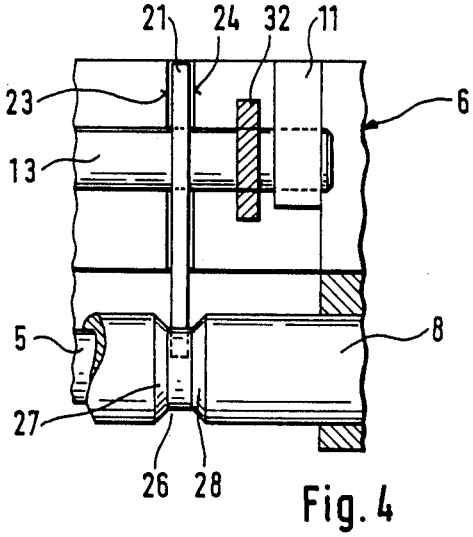
FIG. 4 is an elevational view showing a detail in FIG. 3 as viewed along arrow IV.

FIGS. 3 and 4 show an enlarged soleholder 6 disposed in its normal position. Indentation or recess 22 of soleholder 6 includes two side or lateral faces 23, 24 and an end face 25 which each form one-way coupling elements for interaction with control lever 21. In this respect, bushing 8 which is secured to axle 5 is formed with an annular groove having a trapezoidal cross section formed therein. As seen in FIG. 3, control lever 21 is disposed in annular groove 26 when the soleholder is in its normal position. The oblique side surfaces 27, 28 of annular groove 26 constitutes run-up cams for cooperation with control lever 21. Control lever 21 has a first end and a second end. The first end which is shown at the top of FIG. 3 constitutes a stop for the one way coupling element which is formed by a face 25 of the bottom of indentation 22. In this respect, movement of the soleholder 6 relative to transverse axle 5 will impart to the control lever a rotation about pin 13 in a counterclockwise direction in FIG. 3. In accordance with the present invention, such movements has a result that a contact switch (not shown) in the aforementioned electronic circuit will be actuated when a value determined by the particular design of the jaw unit has been reached. Actuation of the contact switch causes the electronic circuit to deliver a release signal for opening the jaw unit so that the ski boot may be released.

In the embodiment shown, activation of the contact switch results in the energization of the electromagnets of the electronic switch so that the electromagnet actuates a rotary locking member 31 to open a jaw unit in a manner that will now be described. In this respect pin 13, which is parallel to transverse axle 5 and which carries the control lever 21 and supports soleholder 6, is immovably mounted in two thrust bars 32 which are preferably comprised of sheet metal stampings. One end of each thrust bar is connected by a pivot pin 33. A roller 34 is disposed on pivot pin 33 between the thrust bars. Pin 33 also constitutes a displaceable pivot pin for a toggle joint, one arm of which is comprised of two congruent sheet metal stampings 35 which are pivoted on pin 33 between the roller and the thrust rods (see FIG. 2). The other arm 36 of the toggle joint is centrally disposed and is pivoted on a pivot 37 which is fixedly held in stationary lugs 38 which extend from base plate 2. Each lug 38 includes a hole 39 through which one end of an associated helical tension spring 40 is movably mounted. The springs 40 serve as a return spring for the toggle joint and have hook-shaped ends which are received by annular grooves on a pivot pin 41. Pin 41 interconnects arms 35, 36 of the toggle joint and forms a hinge therefore. Adjacent to the toggle hinge, toggle arm 36 has a slot which exposes the central portion of pivot pin 41. When the jaw unit is in its normal position (see FIGS. 1 and 2) this portion of pivot pin 41 is engaged by rotary locking member 31 from above. Thus, the entire mechanism which constitutes the locking means for the soleholder 6 is held in position by a rotary locking member 31. Rotary locking member 31 is biased in a counterclockwise direction by a restraining spring (not shown). Movement of the rotary locking member 31 in the counterclockwise direction is limited by engagement of a nose 42 with base plate 2 on which rotary locking member is pivoted on pivot 43. Pivot 43 and the three pivots of the toggle joint are parallel to pin 13 and to transverse axle 5.

Figure 5:
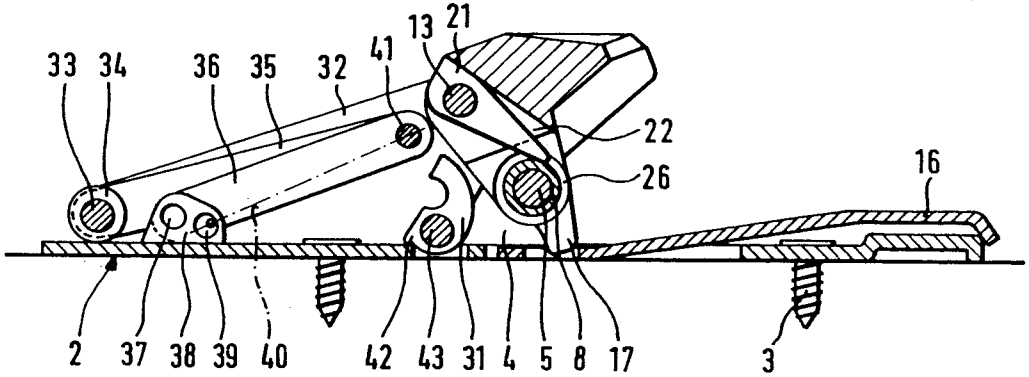
FIG. 5 is an elevational sectional view similar to FIG. 1 showing the jaw unit at the time at which the boot is being released in response to a release signal.

FIGS. 1 and 4 show the jaw unit (and its movable parts) in a normal position in which a ski boot which has been received by the binding is retained on the ski. As set forth above, soleholder 6 is displaceable on transverse axle 5 laterally to both sides of the ski against the force of helical compression spring 9 to an extent which corresponds to the width of the associated gap 10. Soleholder 6 is also pivotally rotatable about the transverse axle 5 against the force of helical compression spring 15 to a limited extent determined by the length of slots 12. As will be appreciated, the transverse movement in a given direction will be imparted when a sufficiently strong lateral force is exerted on the soleholder. Pivotal movement is imparted when an adequate rearward and forward load, i.e. by a corresponding tension or pressure exerted by the toe end 1 of the sole. As will be appreciated, such movement of the soleholder relative to transverse axle 5 will always impart to control lever 21 a pivotal movement about pin 13. At a predetermined position of its rotary movement, control lever 21 will then actuate the contact switch (not shown) of the electronic circuit such that an electromagnet is energized in a known manner to impart to the rotary locking member 31 a pivotal movement to an open position against the force of its restraining spring (not shown). The force which is transmitted from the sole of the boot to the soleholder applies a pressure to the thrust bars 32 such that the latter are no longer held in position and the instantaneous position shown in FIG. 5 is assumed at the time at which the toe end 1 of the sole is released by the soleholder 6. As shown in FIG. 5, soleholder 6 has performed a corresponding pivotal movement about transverse axle 5 and roller 34 has rolled forward on base plate 2 a corresponding distance. This has been accomplished in that the toggle joint 41 has been unlocked and has performed an upward pivotal movement.

Immediately after release of the toe end of the sole by soleholder 6, the latter is returned from the release position shown in FIG. 5 to the normal position shown in FIG. 1 by the action of helical tension springs 40 which have been stressed during the upward pivotal movement of the toggle joint and which are now pulling back the toggle joint. During such movement, the toggle joint moves past the locking end of rotary locking member 31 which has previously been returned to its initial position under the influence of its restraining spring. The jaw unit heretofore described has been directed to a unit for sensing and releasing a ski boot. In situations where the release of a locking means will not be required, i.e. wherein the soleholder acts as a sensing device, pin 13 may be fixed to base plate 2 rather than being movably mounted in thrust bars 32. With such an arrangement, the ski boot may be released by the second jaw unit which holds the sole at its heel end, and such release may be effected when the electronic circuit delivers to the second jaw unit a release command as a result of predetermined limiting values having been exceeded by the sensing unit.

The present invention has been described with respect to a jaw unit for holding the toe end of a ski boot. It will of course be appreciated that the present invention may be used as a heel holding device. Additional modifications and alterations will occur to others upon the reading and understanding of this specification. It is intended that all such modifications and alterations be included insofar as they come within the scope of the patent as claimed or the equivalents thereof.

Having thus described the invention, the following is claimed:

1. A releasable safety ski binding for retaining a ski boot on a ski, said binding comprising:

a base plate attachable to a ski, an axle mounted on said base plate, said axle being transverse to the axis of said ski and parallel to the surface thereof, a cam surface on said axle, a boot holder mounted on said axle for rotational and axial movement thereon, said boot holder dimensioned to hold said ski boot laterally and from above and having a boot holding position and a boot release position, first spring means operable to bias said boot holder into rotation about said axle toward said boot holding position, second spring means disposed between said axle and said boot holder operable to bias said boot holder to a central position on said axle, a locking mechanism movable between a first position and a second position, a release member engaging said locking mechanism for holding said locking mechanism in said first position and releasing said locking mechanism to said second position, pin means for connecting said locking mechanism to said boot holder, said pin means being secured to said locking mechanism and received in slot means in said boot holder such that said boot holder is pivotally movable to a small extent from said boot holding position when said locking mechanism is in said first position, said boot holder being in said boot holding position when said locking mechanism is in said first position and said boot holder being in said boot release position when said locking mechanism is in said second position, control lever means rotatably and axially movable on said pin means for controlling release of said release member, said control lever means operable to release said release member after predetermined rotation thereof, said control lever having a first lever end engaging said cam surface on said axle and a second end operative to engage said boot holder, wherein said boot holder engages said second lever end and imparts rotational movement to said control lever when said boot holder moves from said boot holding position, and means for axially moving said control lever along said pin means as said bootholder moves along said axle, wherein said first lever end moves along said cam surface which imparts rotational movement to said control lever as said bootholder moves from said central position.

2. A binding as defined in claim 1 wherein:

said soleholder is mounted on said axle on two spaced-apart stationary bushings and includes a cylindrical recess coaxial with said axle.

3. A binding as defined in claim 2 wherein said second spring means is a helical compression spring mounted on said axle between said bushings and within said cylindrical recess wherein said spring bears at both ends on said bushings and on said soleholder.

4. A binding as defined in claim 3 wherein said bushings differ in length and said cylindrical recess in said soleholder is eccentrically disposed.

5. A binding as defined in claim 1 wherein said binding includes a footplate on said base plate for supporting said boot, said footplate being movable in a predetermined direction relative to said baseplate in response to pressure exerted thereon by said ski boot, said foot plate further including an aperture therethrough, and said soleholder including a downward arm in operative engagement with said aperture in said footplate wherein movement of said footplate in said predetermined direction rotate said soleholder about said axle toward said boot release position.

6. A ski binding as defined in claim 1 wherein said means for moving said control lever is comprised of a recess in said soleholder for receiving said control lever, said recess having lateral side walls and a vertical face, said side wall operable to engage and move said control lever axially along said pin means as said soleholder moves axially along said axis, said vertical face operative to engage said second lever end.

7. A ski binding as defined in claim 1 wherein said locking mechanism is comprised of a toggle joint assembly.

8. A ski binding as defined in claim 7 wherein said release member is pivotally mounted on a pivot which is parallel to said axle and engages a pin in said toggle joint assembly.

9. A releasable safety ski binding for retaining a ski boot on a ski, said binding comprising:

a base plate attachable to a ski, an axle mounted on said base plate, said axle being transverse to the axis of said ski and parallel to the surface thereof, a cam surface on said axle, a boot holder mounted on said axle for rotational and axial movement thereon, said boot holder dimensioned to hold said ski boot laterally and from above and having a boot holding position and a boot release position, first spring means operable to bias said boot holder into rotation about said axle toward said boot holding position, second spring means disposed between said axle and said boot holder operable to bias said boot holder to a central position on said axle, pin means mounted on said base plate, said pin means being received in slot means in said boot holder such that said boot holder is pivotally movable to a small extent from said boot holding position, control lever means rotatably and axially movable on said pin means operable to cause said bootholder to move from said bootholding position to said boot release position upon predetermined rotation thereof, said control lever having a first lever end engaging said cam surface on said axle and a second end operative to engage said boot holder, wherein said boot holder engages said second lever end and imparts rotational movement to said control lever when said boot holder rotates from said boot holding position, and means for axially moving said control lever along said pin means as said soleholder moves along said axle, wherein said first lever end moves along said cam surface which imparts rotational movement to said control lever as said bootholder moves a predetermined distance from said central position.

10. A binding as defined in claim 9 wherein:

said soleholders are mounted on said axle on two spaced-apart stationary bushings and includes a cylindrical recess coaxial with said axle.

11. A binding as defined in claim 9 wherein said second spring means is a helical compression springs mounted on said axle between said bushings and within said cylindrical recess wherein said spring bears at both ends on said bushings and on said soleholder.

12. A binding as defined in claim 9 further comprising:

a locking mechanism movable between a first position and a second position, and a release member engaging said locking mechanism for holding said locking mechanism in said first position and releasing said locking mechanism to said second position.

* * * * *